United States Patent [19]

Mischenko et al.

[11] 4,079,920

[45] Mar. 21, 1978

[54] METAL-MELTING FURNACE

[76] Inventors: Valentin Dmitrievich Mischenko, Odintsovsky raion, poselok Nemchinovka, Ovrazhnaya ulitsa, 6, Moskovskaya oblast; Artur Eduardovich Mikelson, ulitsa Miera, 16/4, kv. 36, Latviiskaya SSR, Rizhsky raion, p/o Salaspils, both of U.S.S.R.

[21] Appl. No.: 800,841

[22] Filed: May 26, 1977

[30] Foreign Application Priority Data

May 28, 1976 U.S.S.R. ..... 2363155

[51] Int. Cl.[2] ..... C21C 7/00

[52] U.S. Cl. ..... 266/237; 222/594; 417/50

[58] Field of Search ..... 222/594; 266/234, 237; 417/50

[56] References Cited

U.S. PATENT DOCUMENTS

| | | | |
|---|---|---|---|
| 3,684,402 | 8/1972 | Starck | 417/50 |
| 3,738,777 | 6/1973 | Starck et al. | 417/50 |

*Primary Examiner*—Gerald A. Dost

*Attorney, Agent, or Firm*—Burgess, Ryan and Wayne

[57] ABSTRACT

The furnace has an oblique wall extending at an obtuse angle to the furnace hearth, and arranged below said wall is a travelling magnetic field inductor intended for moving a flow of molten metal to be directed downwards along the oblique wall for stirring the metal and upwards for the delivery of metal from the furnace. An inclined partition wall is provided over the oblique wall to run in parallel therewith above the metal discharging hole, the partition wall extending to the metal level in the furnace and short of the furnace hearth. A plate made of non-magnetic material is secured to the oblique wall on the side of location of the inductor, the fastening devices of the plate allowing its dimensions to be changed upon heating of the plate.

2 Claims, 2 Drawing Figures

METAL-MELTING FURNACE

BACKGROUND OF THE INVENTION

The invention relates to metal melting furnaces to be used in foundry practice.

The present invention may be most advantageously used in furnaces and mixers for producing metal which is fed in pre-set batches directly to continuous casting machines or injection moulding machines. The furnace according to the invention should be preferably used for melting aluminium and aluminium based alloys.

Known in the art are metal melting furnaces having the inner space defined by vertical walls supported by a hearth and bearing a roof. The inner space of the furnace is lined with refractory material, with heaters being accommodated therein above the molten metal level to melt the metal.

In some furnaces, mechanical devices are used for stirring molten metal to even its temperature, and additional heaters are provided to prevent metal from cooling and solidifying at the hearth or in the zone of delivery. The furnace has respective holes for charging the starting metal and for the delivery of finished metal therethrough. The delivery hole is located below the level of molten metal in the furnace and is closed by a pick (metal rod) which is used by the operator to manually control the batch of metal discharged from the furnace with subsequent closing of the hole.

These furnaces have low production output which renders them impractical.

In addition, the metal obtained from such furnaces contains a great quantity of undesired gaseous and solid impurities.

There is also known in the art an arrangement for conveying liquid metal, based on the employment of travelling magnetic field of an inductor (cf. USSR Inventor's Certificate No. 321320). However, this arrangement can only be used at relatively low temperatures for transporting and stirring liquid metals, such as mercury.

The development of mechanical engineering imposes an ever-growing demand for improving the quality and quantity of metal being produced.

Not only do the prior art furnaces fail to meet this demand, but they are unsuitable for automation and do not provide for efficient stirring of metal during its heating.

The above disadvantages adversely affect the operation of the furnaces and render impossible their redesigning.

SUMMARY OF THE INVENTION

It is the primary object of the invention to provide a metal melting furnace which has an improved output as compared to the furnaces intended for the same purpose.

Another important object of the invention is to provide for automatic control of the metal delivery from the furnace in the course of melting operation.

Still another important object of the invention is to improve the quality of molten metal delivered from the furnace by reducing the content of injurious solid and gaseous impurities.

These and other objects are attained in a metal melting furnace having an inner space defined by walls supported by a hearth and bearing a roof and communicating with a hole for the delivery of metal from the furnace, a heater arranged above the molten metal level and a travelling magnetic field inductor acting on molten metal, wherein, according to the invention, the travelling magnetic field inductor is arranged below an oblique wall extending at an obtuse angle to the furnace hearth in the zone of direct heating of metal by the heater, and in that a plate made of non-magnetic material is secured to the wall at the side of the travelling magnetic field inductor, the fastening device of the plate allowing its dimensions to be changed during heating.

Such construction of the furnace with the oblique wall and with the travelling magnetic field inductor arranged thereunder permits directing the molten metal downwards along the oblique wall for its stirring and for stepping up the melting process, and upwards to cause metal delivery from the furnace.

The direction of metal flow within the furnace corresponds to the direction of the inductor travelling magnetic field which is reversed by appropriately switching over the phases of current supplied to the inductor.

The oblique wall of the furnace is made thin at the place where the inductor is arranged, said wall being supported by a plate made of non-magnetic material so that the travelling magnetic field of the inductor is free to act on the metal in the furnace.

In order to prevent the oblique wall deformation caused by heating, the latter is connected to the plate by means of bolts received in the plate holes with a space sufficient to permit displacement during heating so that the plate constitutes a kind of a sliding shield.

An inclined partition wall made of heat conducting material is preferably provided in the inner space of the furnace, the partition wall extending to the molten metal level in the furnace and short of the hearth and arranged above the metal discharging hole over the oblique wall and running substantially parallel with the latter.

The partition wall defines, together with the oblique wall, a metal duct through which the molten metal is delivered from the furnace and permits the metal to be delivered at a sufficiently high temperature.

In addition, the partition wall is immersed in molten metal so that it protects the metal being delivered from the furnace against the oxidizing atmosphere of the furnace and does not permit gases to emerge from the furnace through the metal delivery hole, thus protecting the shop atmosphere from pollution.

BRIEF DESCRIPTION OF THE DRAWINGS

The invention will now be described with reference to a specific embodiment of the metal melting furnace illustrated in the accompanying drawings, in which.

DETAILED DESCRIPTION OF THE INVENTION

Figure 1:
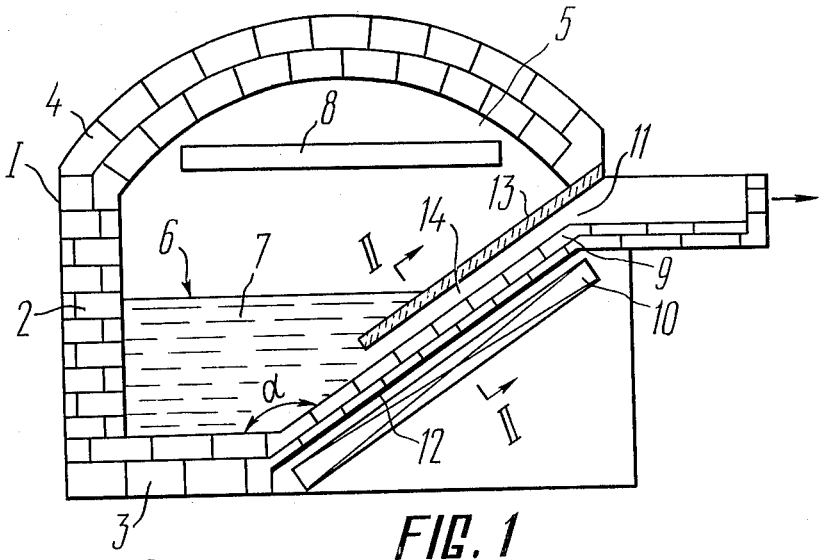
FIG. 1 is a vertical section of the furnace according to the invention.

The furnace has a casing 1 (FIG. 1) enclosing walls 2 which are lined with refractory material, supported by a hearth 3 and bearing a roof 4. An electric or gas heater 8 is accommodated in the furnace inner space 5 above a bath level 6 of molten metal 7. One of the walls 9 of the furnace is made oblique and extends at an obtuse angle ($\alpha$) to the hearth 3 of the furnace in the zone of direct heating of the metal 7.

Figure 2:
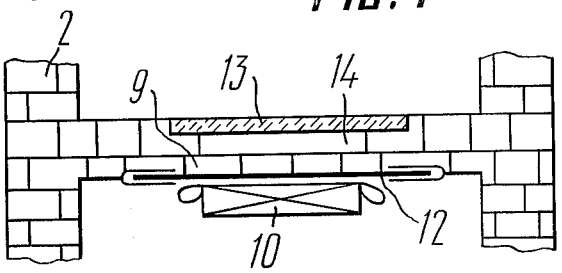
FIG. 2 is a sectional view taken along the line II—II in FIG. 1.

A travelling magnetic field inductor 10 is mounted under the oblique wall 9 (FIG. 2) causing the molten metal to move along the wall 9 downwards for stirring or upwards for its delivery from the furnace through a hole 11 (FIG. 1).

A plate 12 (FIG. 2) made of non-magnetic material is provided between the oblique wall 9 and the travelling magnetic field inductor 10, the plate being secured to the oblique wall 9 by means of bolts (not shown) and appropriate holes allowing the dimensions of the plate 12 and the wall 9 to be changed in the course of their heating.

An inclined partition wall 13, provided in the furnace inner space 5 (FIG. 1), is spaced apart from the hearth 3 and extends above the hole 11 for delivery of the molten metal 7 from the furnace and arranged above the oblique wall 9 to run substantially in parallel therewith. The inclined partition wall 13 and the oblique wall 9 define a metal duct 14 which is acted upon by the travelling magnetic field of the inductor 1 and heaters 8.

The inclined partition wall 13 is made of a refractory heat-conducting material so that it transfers the heat from the heaters 8 to the metal flowing on the oblique wall 9.

In addition, the lower end portion of the inclined partition wall 13 is submerged in the melt 7, thus preventing gases from emerging from the furnace inner space 5 without obstructing the delivery of metal from the furnace due to the fact that the partition wall is spaced apart from the hearth.

The oblique wall 9 and the plate 12 made of non-magnetic material form a sliding shield. This facility prevents the furnace casing 1 from breaking due to thermal strains induced by the difference in temperature and coefficients of thermal expansion of the materials of the wall 9, plate 12 and casing 1 which is made of conventional carbon steel.

Titanium may be used for the manufacture of the non-magnetic plate 12.

Corundum may be used as the high-temperature heat-conducting material for making the inclined partition wall 13.

The furnace functions in the following manner.

The molten metal 7 to be melted is charged to the inner space 5 of the furnace (FIG. 1), and the heater 8 for heating the furnace and melting the metal is put on. Then the travelling magnetic field inductor 10 is put on to cause the metal to flow downwards along the oblique wall 9 in the direction towards the hearth 3 of the furnace. Thus, hotter metal strata are mixed with colder ones, thereby considerably stepping up the metal melting process. At the same time, as the metal flows are mixed, their temperature is averaged. In addition, the flow of heated metal forces the colder stratum of metal from the hearth to the surface 6 of the melt 7 which absorbs the heat from the furnace heaters 8.

When alloying agents are added to the melt 7, the alloy preparation process is considerably improve since the stirring operation substantially improves the homogeneity of the chemical composition over the entire volume of metal.

For the delivery of finished metal from the furnace, the phases of current supplied to the inductor are switched over, and the direction of travelling magnetic field is reversed so that the metal is caused to move upwards along the oblique wall 9 under the inclined partition wall 13 to the metal discharging hole 11. To control the amount of metal delivered from the furnace or step up the rate of metal stirring during its melting, it is sufficient to appropriately increase voltage fed to the inductor 10.

Since the metal duct 14 is permanently in the heating zone of the furnace heater 8, it is sufficiently heated to thereby preclude the cooling (solidification) of metal therein so that no additional heaters are required.

Under the action of electromagnetic field of the inductor, a flow of molten metal is passed upwards along the oblique wall 9 under the inclined partition wall 13 through the metal duct 14 towards the hole 11 for delivery of metal from the furnace. From the furnace, the molten metal is delivered to a user, e.g. to a continuous casting machine or to an injection moulding machine. The amount of metal delivered from the furnace is automatically controlled by varying the voltage fed to the inductor.

The tests conducted with the metal melting furnace according to the invention showed that metal stirring and its delivery from the furnace could be readily automated. Substantially shorter time was required (by 2–3 times less) for the preparation of an alloy so that the furnace output could be doubled and even tripled. In addition, conditions were provided for additional metallurgical processing of metal within the metal duct during its delivery from the furnace so that the content of non-metallic and gaseous impurities in metal was reduced by 2 to 5 times. It is noted that the temperature gradient in the metal bath of the furnace was 3° C (as compared to 200° C for the prior art furnaces). The burning-out of valuable components of metal was reduced by 20%. Furthermore, homogeneity of chemical composition of melted metal was improved. Metal delivery from the furnace was performed in accordance with a programme and attained 120 metric tons per hour.

Experimental delivery of metal from a mixer to moulds of casting machines during the process of continuously casting ingots was performed without air access. Metal teeming was controlled both manually and automatically. The accuracy of batching with the automatic control was as good as $\pm 1.5$ mm deviation from a pre-set level of metal in the mould. As a result of additional treatment of the metal delivered from the furnace, the content of gaseous impurities was lowered by 70% and the content of solid impurities became from 5 to 6 times lower.

The furnace according to the invention is simple in construction and reliable in operation. The service life of the metal duct (the oblique wall and the inclined partition wall) corresponded to that of the furnace wall lining. Power input per 1 metric ton of delivered or stirred metal was from 2 to 6 kWh.

We claim:

1. A metal melting furnace comprising an inner space defined by walls supported by a hearth and bearing a roof; a heater arranged in the inner space of said furnace above the level of molten metal; one of said walls of the furnace being arranged below a hole for metal delivery and extending at an obtuse angle to the hearth of the furnace in the zone of direct heating by said heater; a travelling magnetic field inductor arranged under said oblique wall at a distance therefrom sufficient for affecting the molten metal; a plate made of non-magnetic material secured to said oblique wall on the side of location of said travelling magnetic field inductor by means of fastening devices which allow the dimensions of the plate to be changed upon heating thereof.

2. A furnace according to claim 1, wherein there is provided in the inner space an inclined partition wall made of heat-conducting material and extending to the metal level in the furnace and short of the hearth of the furnace and arranged above the metal discharging hole over said oblique wall and running substantially parallel with the oblique wall.

* * * * *